US007450095B2

(12) United States Patent
Yu et al.

(10) Patent No.: US 7,450,095 B2
(45) Date of Patent: Nov. 11, 2008

(54) SINGLE-CLUSTER LAMP DRIVE DEVICE

(75) Inventors: Te-Cheng Yu, Chu-Pei (TW); Shang-Che Sun, Chu-Pei (TW); Chih-Wei Lai, Chu-Pei (TW); Huang-Ta Chiu, Chu-Pei (TW); Wan-Chih Lin, Chu-Pei (TW); Hao-Fan Liao, Chu-Pei (TW); Ming-Chu Hsu, Chu-Pei (TW)

(73) Assignee: Ownway Tech Corporation, Hsinchu (TW)

( * ) Notice: Subject to any disclaimer, the term of this patent is extended or adjusted under 35 U.S.C. 154(b) by 680 days.

(21) Appl. No.: 11/087,554

(22) Filed: Mar. 24, 2005

(65) Prior Publication Data

US 2006/0214877 A1 Sep. 28, 2006

(51) Int. Cl.
*G09G 3/32* (2006.01)

(52) U.S. Cl. ..... 345/82

(58) Field of Classification Search ..... 345/46, 345/82–84; 257/443

See application file for complete search history.

(56) References Cited

U.S. PATENT DOCUMENTS 4,213,189 A * 7/1980 Mueller et al. ..... 345/551
4,232,376 A * 11/1980 Dion et al. ..... 365/222
4,254,498 A * 3/1981 Tawara et al. ..... 370/217
4,745,485 A * 5/1988 Iwasaki ..... 348/791
4,789,960 A * 12/1988 Willis ..... 345/534
4,954,826 A * 9/1990 Isozaki et al. ..... 341/100
2003/0158934 A1 * 8/2003 Chang ..... 709/224
2005/0116967 A1 * 6/2005 Shirasaki et al. ..... 345/690

* cited by examiner

*Primary Examiner*—Sumati Lefkowitz
*Assistant Examiner*—Rodney Amadiz
(74) *Attorney, Agent, or Firm*—Rosenberg, Klein & Lee

(57) ABSTRACT

A single-cluster lamp drive device makes use of a controller to receive video data from a control system and then divides the video data into three sub video data. Next, these three sub video data are simultaneously and repetitively outputted to a digital-to-analog converter in every fixed time interval. Subsequently, the digital-to-analog converter converts these three sub video data to three analog voltages outputted to a voltage-to-current converter. Finally, the voltage-to-current converter converts these three analog voltages to three analog currents for driving light emitting devices to emit light, hence accomplishing voltage-in-current-out driving. The drive device drives a single-cluster lamp composed of one LED or several LEDs to adjust their brightness through current change, thereby coordinating with the control system to produce various color and pattern variations.

6 Claims, 3 Drawing Sheets

SINGLE-CLUSTER LAMP DRIVE DEVICE

BACKGROUND OF THE INVENTION

1. Field of the Invention

The present invention relates to a drive device for driving a single-cluster lamp composed of one LED or several LEDs to emit light.

2. Description of Related Art

A light emitting diodes (LED) is a light emitting device made of semiconductor material. It has two electrode terminals. If a voltage is applied across these two terminals and a very small current is provided, light will be emitted through recombination of electrons and holes therein. This is the light emission principle of the LED.

Different from common incandescent bulbs, the LED belongs to cold light emission devices, and has the advantages of low power consumption, long lifetime, no warm-up time required, and fast response speed. It has a small size, can endure shocks, and is suitable for mass production. Moreover, LEDs can be made into a very small or arrayed device to meet the requirements in application. Today, LEDs have been widely used on pointers and display devices of information, communication and consumer electronics products. They have become important components in everyday life of people.

LEDs are primarily used in traffic lights, car indication lights, brake lights, and so on. A full-color LED display makes use of a display screen composed of red, green, and blue (the three primary colors) LEDs, and is widely used as a stadium billboard, a street advertisement billboard, and so on. Along with popularization of mobile phones and other portable electronic products, LEDs have become indispensable light emitting devices. Because LEDs have the advantages of small size, fast on speed, and long lifetime, they will replace part of lighting in the future.

Because the application of LED is universal, various kinds of drive circuits and drive chips come into being. FIG. 1 is a voltage versus current characteristic curve of an ordinary diode. Except for some specific usages, a diode generally operates under forward bias. The relationship between the voltage and current of diode is expressed with an exponential curve. When the voltage across two terminals of a diode exceeds a certain voltage $V_f$ (which is usually termed as the cut-in voltage or the threshold voltage, and is about 0.5-0.8V, depending on the diode material and doping concentration), the current of the diode increases abruptly. Before this cut-in voltage, the current in the diode is very small. The characteristics of an LED is the same as those of a diode. As its name implies, an LED will emit light when it is forward biased.

LEDs are usually made of GaAsP or GaP. With different materials, the emission wavelengths and thus colors will be different. For example, a GaAsP LED emits red light, while a GaP LED emits a light color between yellow and green. The luminance and conduction current of an LED is in a proportional relation, as shown in FIG. 2. Therefore, in order to keep a certain brightness in practical applications, the drive circuit is generally designed to be of constant current driving. This will also lengthen the use lifetime of an LED.

SUMMARY OF THE INVENTION

An object of the present invention is to provide a single-cluster lamp drive device for driving a single-cluster lamp composed of one LED or several LEDs in a voltage-in-current-out way. The LEDs adjusts their brightness through current change. By coordinating with a control system, several drive devices can be used to separately drive several single-cluster lamps to produce various color and pattern variations.

The present invention drives a plurality of light emitting devices in a single-cluster lamp to emit light based on video data from the control system. The drive device uses a controller to receive the video data and then divides the video data into three sub video data. Next, these three sub video data are repetitively outputted to a digital-to-analog converter in every fixed time interval. Subsequently, the digital-to-analog converter converts these three sub video data to three analog voltages outputted to a voltage-to-current converter. Finally, the voltage-to-current converter converts these three analog voltages to three analog currents for driving these light emitting devices to emit light.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
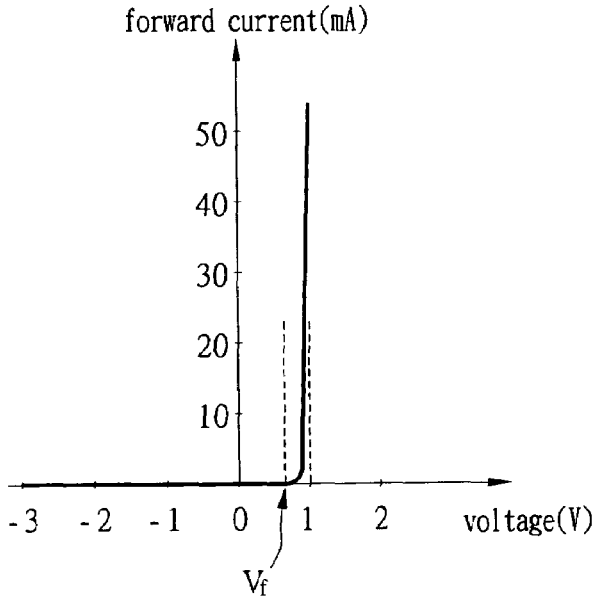
FIG. 1 PRIOR ART
FIG. 1 is a voltage versus current characteristic curve of a conventional diode.
Figure 2:
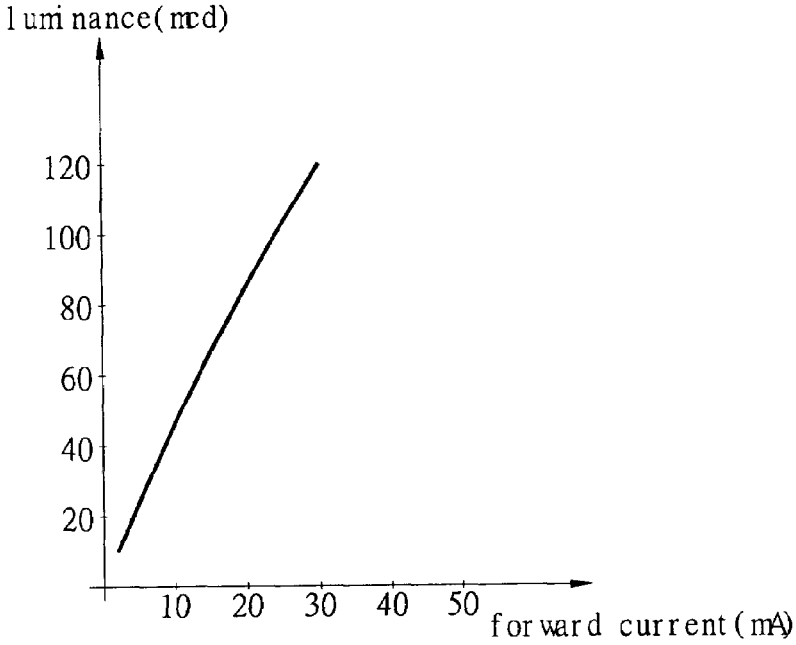
FIG. 2 PRIOR ART
FIG. 2 is a luminance versus conduction current relationship diagram of a conventional diode.
Figure 3:
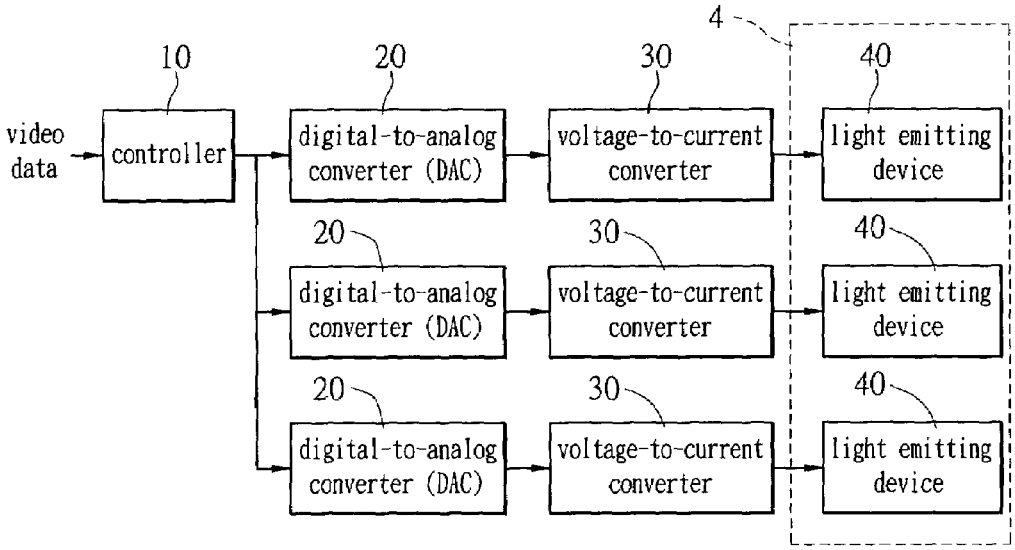
FIG. 3 is a circuit block diagram of a single-cluster lamp drive device of the present invention.

FIG. 3 is a circuit block diagram of a single-cluster lamp drive device of the present invention. A drive device drives three light emitting devices 40 in a single-cluster lamp 4 based on a video data. The single-cluster lamp drive device comprises a controller 10, three digital-to-analog converters 20, and three voltage-to-current converters 30. The controller 10 is used for receiving the video data and dividing the video data into three sub video data for output. The three digital-to-analog converters 20 are connected to the controller 10 and used to convert the three sub video data to three analog voltages for output. The three voltage-to-current converters 30 are respectively connected to the digital-to-analog converters 20 and the single-cluster lamp 4 and used to convert the three analog voltages to three analog currents for driving the light emitting devices 40 to emit light.

The controller 10 repetitively sends the three sub video data to the three digital-to-analog converters 20 in every fixed time interval to change light emission situations of the light emitting devices 40. The light emitting device 40 is formed by connecting at least an LED. The single-cluster lamp 4 is composed of at least a series-connected red LED, at least a series-connected green LED, and at least a series-connected blue LED, which are parallel connected together. The voltage-to-current converter 30 is a transconductance amplifier.

Figure 4:
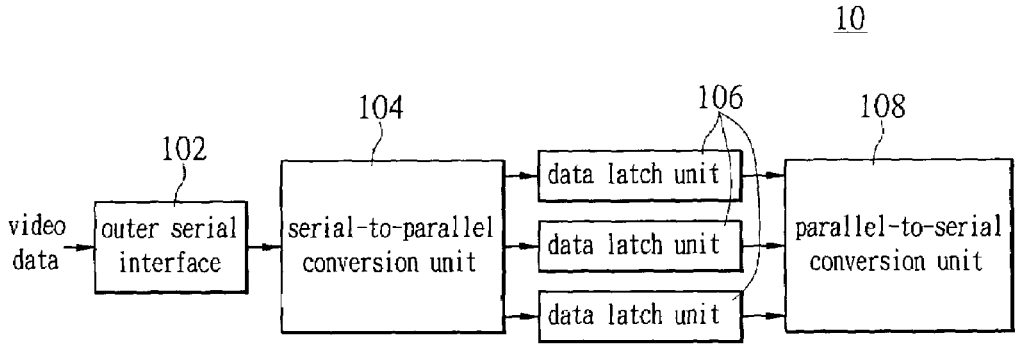
FIG. 4 is a circuit block diagram of a controller used in the present invention.

Reference is made to FIG. 4 as well as FIG. 3. The controller 10 uses an outer serial interface 102 to receive a video data from a control system (not shown) by means of serial data transmission. The video data is divided into three sub video data (respectively for the three primary colors of red, green, and blue) by a serial-to-parallel conversion unit 104 connected to the outer serial interface 102. Three data latch units 106 are connected to the serial-to-parallel conversion unit 104 and used to respectively receive and latch the three sub video data. A parallel-to-serial conversion unit 108 is connected to the three data latch units 106 and used to convert the three latched sub video data to serial data for output. Moreover, the parallel-to-serial conversion unit 108 provides a scanning function to repetitively send out the sub video data on the data latch units 106. The present invention adopts the serial data transmission method to reduce EMI and failure possibility.

Figure 5:
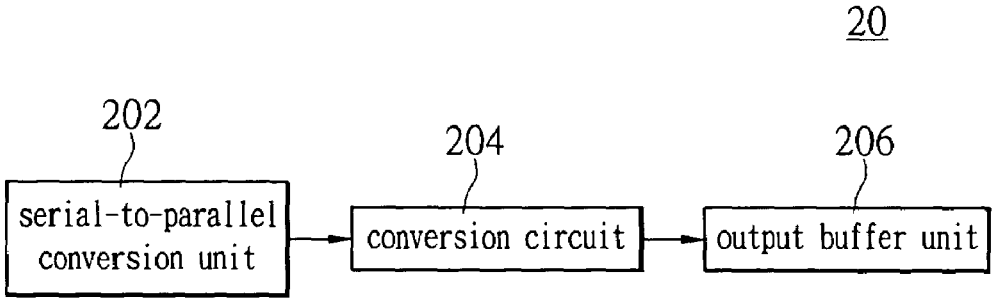
FIG. 5 is a circuit block diagram of a digital-to-analog converter used in the present invention.

Reference is made to FIG. 5 as well as FIG. 3. The digital-to-analog converter 20 comprises a serial-to-parallel conversion unit 202, which is connected to the controller 10 and used to get a serial sub video data outputted by the controller 10 and then convert it to parallel data for output. A conversion circuit 204 is connected to the serial-to-parallel conversion unit 202 and used to receive the parallel sub video data and then convert it to an analog voltage for output.

Figure 6:
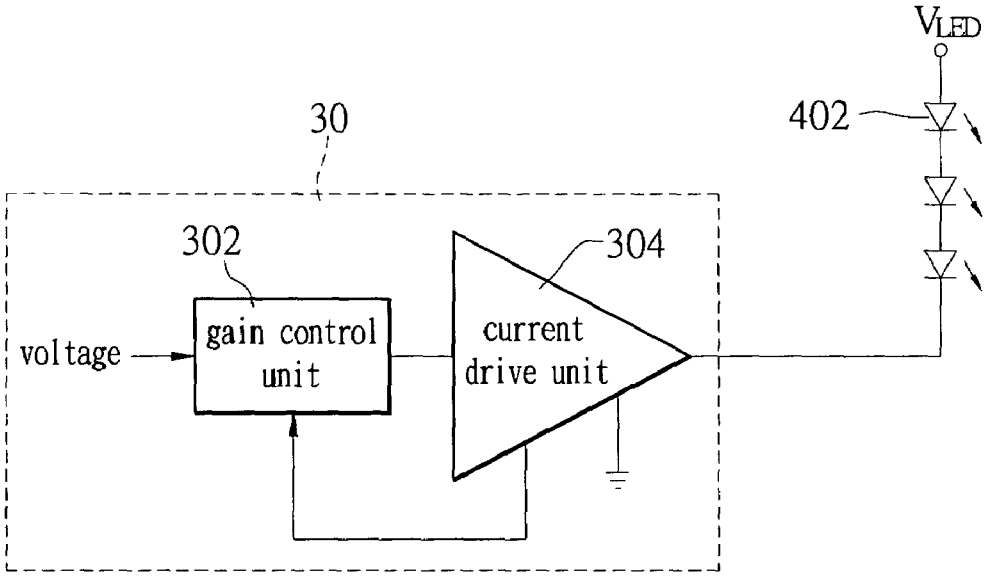
FIG. 6 is a circuit block diagram of a voltage-to-current converter of the present invention.

The digital-to-analog converter 20 further comprises an output buffer unit 206, which is connected to the conversion circuit 204 and used for buffered output of the analog voltage. As shown in FIG. 6, the voltage-to-current converter 30 comprises a current drive unit 304. A gain control unit 302 is connected to the current drive unit 304 in a feedback way. The feedback network can reduce influence due to gain difference of the current drive unit 304. The gain control unit 302 is connected to the output buffer unit 206 of the digital-to-analog converter 20 and used to amplify the analog voltage for output. The amplified analog voltage is transmitted to the current drive unit 304 for proportional analog current output. The analog current can be used to drive the LEDs 402 in the light emitting device 40. The brightness of the LEDs 402 is controlled by the analog current outputted by the voltage-to-current converter 30 and a power source $V_{LED}$.

To sum up, the present invention drives a single-cluster lamp composed of one LED or several LEDs in a voltage-in-current-out way. The LEDs adjusts their brightness through current change. By coordinating with a control system, several drive devices can be used to separately drive several single-cluster lamps to produce various color and pattern variations.

Moreover, the drive device of the present invention uses a controller to receive a video data and divide the video data into a plurality of sub video data. The plurality of sub video data are repetitively outputted to a digital-to-analog converter in every fixed time interval. The digital-to-analog converter converts these sub video data to a plurality of analog voltages outputted to a voltage-to-current converter. The voltage-to-current converter converts these analog voltages to a plurality of analog currents for separately driving these light emitting devices to emit light. A single-cluster lamp composed of one LED or several LEDs can thus be driven in a voltage-in-current-out driving way.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A single-cluster lamp drive device for driving a plurality of light emitting devices in a single-cluster lamp based on a video data, said drive device comprising:

a controller for receiving said video data and dividing said video data into a plurality of sub video data for output, said controller including:

an outer serial interface for receiving said video data by means of serial data transmission;

a serial-to-parallel conversion unit connected to said outer serial interface and used to divide said video data into said plurality of sub video data;

a plurality of data latch units connected to said serial-to-parallel conversion unit and used to separately receive said plurality of sub video data;

a parallel-to-serial conversion unit connected to said plurality of data latch units and used to convert said plurality of latched sub video data to serial data for output;

a digital-to-analog converter connected to said controller and used to convert said sub video data to a plurality of analog voltages for output; and a voltage-to-current converter connected to said digital-to-analog converter and said single-cluster lamp and used to convert said analog voltages to a plurality of analog currents for driving said light emitting devices;

whereby said controller repetitively sends said sub video data to said digital-to-analog converter in every fixed time interval to change light emission situations of said light emitting devices.

2. The single-cluster lamp drive device as claimed in claim 1, wherein said light emitting device is formed by connecting at least an LED.

3. The single-cluster lamp drive device as claimed in claim 1, wherein said single-cluster lamp is composed of at least a series-connected red LED, at least a series-connected green LED, and at least a series-connected blue LED, which are parallel connected together.

4. The single-cluster lamp drive device as claimed in claim 1, wherein said digital-to-analog converter comprises:

a plurality of serial-to-parallel conversion units connected to said controller and used to separately convert said plurality of sub video data to parallel data for output; and a plurality of conversion circuits respectively connected to said plurality of serial-to-parallel conversion units and used to convert said parallel data to said plurality of analog voltages for output.

5. The single-cluster lamp drive device as claimed in claim 4, further comprising a plurality of output buffer units, wherein said plurality of output buffer units are respectively connected to said plurality of conversion circuits for buffered output of said plurality of analog voltages.

6. The single-cluster lamp drive device as claimed in claim 1, wherein said voltage-to-current converter is a transconductance amplifier.

* * * * *